United States Patent [19]

Bianchi et al.

[11] Patent Number: 4,542,841

[45] Date of Patent: Sep. 24, 1985

[54] SEMI-FRONT OPENING HOLSTER

[75] Inventors: John E. Bianchi; Richard D. E. Nichols, both of Fallbrook; Richard Gerfen, Murrieta, all of Calif.

[73] Assignee: Bianchi International, Temecula, Calif.

[21] Appl. No.: 231,509

[22] Filed: Feb. 3, 1981

[51] Int. Cl.[4] ..... F41C 33/02

[52] U.S. Cl. ..... 224/193; 224/243; 224/911

[58] Field of Search ..... 224/193, 198, 238, 243, 224/250, 911

[56] References Cited

U.S. PATENT DOCUMENTS

| | | | |
|---|---|---|---|
| 3,645,428 | 2/1972 | Angell | 224/911 X |
| 3,942,692 | 3/1976 | Chica | 224/243 |
| 4,084,734 | 4/1978 | Bianchi et al. | 224/193 X |
| 4,270,680 | 6/1981 | Bianchi | 224/193 |
| 4,303,185 | 12/1981 | Shoemaker | 224/193 |

*Primary Examiner*—Steven M. Pollard
*Attorney, Agent, or Firm*—John E. Wagner

[57] ABSTRACT

A semi-front opening holster comprising a body of leather or leatherlike material formed to define a handgun carrying pouch;

means secured to the body for securing the holster to a belt;

the body defining a top opening for the insertion of a handgun into the holster from the top;

the body at the upper rear thereof defining a pouch region for at least partially enclosing the trigger guard of a handgun when positioned within the holster;

the pouch region including means extending above and over the trigger guard of the handgun whereby a handgun within the holster may not be withdrawn directly upward;

the handgun body defining an extension of the top opening along the front edge thereof;

whereby a handgun contained within the holster may be removed by tilting forward to clear the trigger guard from the pouch region and thereafter removing the handgun entirely from the holster by an upward or upward-forward movement.

1 Claim, 9 Drawing Figures

SEMI-FRONT OPENING HOLSTER

BACKGROUND OF THE INVENTION

In recent years, the front opening holster as typified by that disclosed in U.S. Pat. No. 3,630,420 has gained wide spread acceptance particularly because of its resistance to unauthorized withdrawal by an assailant who attempts to remove an officer's handgun by approaching the officer from the rear and pulling the handgun upward. The features of the front opening holster which prevent such occurance are best described in the aforementioned patent and have been reported to have saved the lives of a number of law enforcement officers. The front opening holster is distinct in appearance, characterized by an opening which extends from top to bottom at the front of the holster. Some officers find the appearance less than attractive and consequently some have continued to use the pouch type holster with the loss of the protective features of the front opening holster.

Faced with this situation, we set about to determine if the advantages of a front opening holster could be achieved in a design which does not depart so radically from conventional pouch type holsters while giving the protective features so needed for the safety of law enforcement officers.

BRIEF STATEMENT OF THE INVENTION

Given the foregoing state of the art and the existant real need, we determined that the enclosing of the muzzle portion of a front opening holster while leaving the upper portion openable presented the general appearance of a pouch holster and allowed a modified front drawing procedure to be achieved. We also determined to our surprise that the enclosing of the muzzle region of the handgun allowed a more positive form of upward restraint to be used with even increased protection from unauthorized drawing of the handgun. Specifically, we determined that a strap which is located at the upper rear of the holster can form a secondary pouch into which the trigger guard of the handgun may be positively held to be drawn only forward. The restraint on the handgun by this upper rear pouch and the front lower muzzle restraint proved increased positive protection.

A hammer guard strap extending across the hammer region of the handgun provided a third point of restraint whereby the handgun in the holster is held within triangle of leather restraint means. Release of the one restraint, namely the hammer guard strap, allows the easy drawing of the handgun. This is accomplished by the officer merely by releasing this one strap as by thumb action.

We further discovered that the front opening should extend at least one fourth of the way from the top opening toward the muzzle region whereupon the officer can draw the handgun by a more natural motion than either the case of the front opening or pouch type holsters. These bonus advantages have resulted in a holster having the attractive appearance of a pouch holster, improved security over a front opening holster and ease of drawing over both.

BRIEF DESCRIPTION OF THE DRAWING

This invention may be more clearly understood from the following detailed description and by reference to the drawing in which.

DETAILED DESCRIPTION OF THE INVENTION

Figure 1:
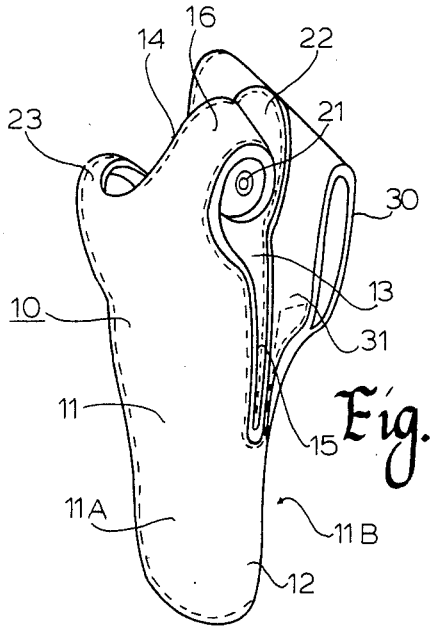
FIG. 1 is a perspective view of a holster of this invention.

The general appearance of the preferred embodiment of this invention may be seen in FIG. 1 as a holster 10 including a body portion 11 produced from a piece of leather or leather-like material which formed into a pouch with a fold 12 at the front and a handgun recess 13 having a top opening 14 and a front extension 15 of that top opening which extends part way down the front fold 12.

A hammer guard 16 carrying one part 21 of a snap fastener extends over and bisects the top opening 14. The hammer guard 16 engages a thumb strap 22 which is integrally formed as a part of the inner face of the body 11 while the hammer guard is formed integrally as a part of the outer face 11B of the body 11. The thumb strap 22 carries the mating fastener part to part 21 but unshown in FIG. 1.

The hammer guard 16 as its name implies is positioned to overly and protect the hammer of a handgun when in place in the recess 13. In fact the hammer guard 16 rests behind the hammer of the handgun and prevents cocking while the handgun is holstered.

A second strap, namely trigger guard strap 23 extends across the upper rear portion of the holster and overlies the rear of the trigger guard of a holstered handgun passing between the rear of the trigger guard and the inside of the grip of the handgun. The strap 23 is preferably formed integrally with the outer face 11A of the holster body 11 and is secured permanently to the inner face 11B of the holster body. The rear of the holster body 11 and the strap 23 define a pouch region for the trigger guard of the handgun with the opening of the pouch opening frontward so that the trigger guard of the handgun may not be released by upward forces applied to the handgun but only frontward forces may dislodge the trigger guard from the strap 23.

The fold 12 prevents the muzzle region of the handgun from exiting the holster directly forward since a typical handgun will have the last two or three inches of its barrel lying within the fold 12 when the handgun is properly holstered.

Figure 2:
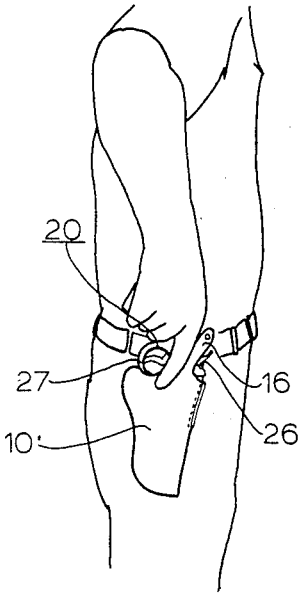
FIGS. 2 through 4 are side view of an officer in the act of drawing a handgun from the holster of this invention.
Figure 3:
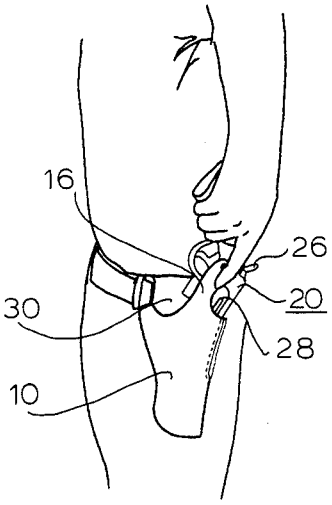
Figure 4:
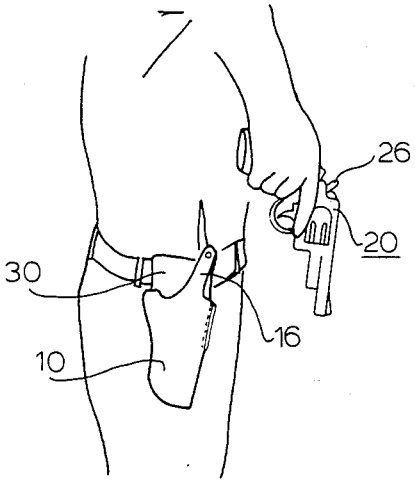

The holster 10 is supported on the belt of the wearer as shown in FIGS. 2 through 4 by a belt loop assembly 30 of FIG. 1. The belt loop assembly 30 is formed of leather or leather-like material similar to the holster body 11 and includes an internal formed metal reinforcement which provides for the offset 31, clearly visible in FIGS. 1, 5 and 6. The belt loop assembly 30 is secured to the lower region of the holster body 11 to provide for low mounting on the wearer allowing the holster to be worn with the short type jackets. The details of this low mounting may be seen in FIG. 9 and in much more detail in U.S. Pat. No. 3,749,293 issued to John E. Bianchi, one of the inventors hereof on July 31, 1973. Other types of belt loops may be used such as the integral belt loop formed from an upward extension of the holster body which is folded back down upon itself defining a belt loop between return fold and the holster body. We have found, however, that the low mount loop assembly of the above referenced patent is preferred since it provides for broad support on the belt, is relatively rigid due to the internal reinforcing and is adjustably tightened on the belt by a self contained locking mechanism which is disclosed in the U.S. Pat. No. 3,749,293, the disclosure of which is hereby incorporated by reference.

Referring now to FIGS. 2 through 4, this holster 10 may be seen in use during the act of drawing handgun 20. The user grasps the grip of the handgun 20 in a normal manner but with his index or trigger finger extended. The user's thumb extends forward directed toward the hammer 26 and in doing so extends between the hammer guard 16 and the thumb strap 22, the latter of which does not appear in these figures. The user presses the handgun forward and in the process, this thumb bears between the frame of the handgun and the thumb strap 22 causing the fastener 21 to release and the hammer guard 16 to spring upward into the position shown in FIG. 2. The forward movement of the arm and handgun after release of the hammer strap 16 next becomes a forward and upward movement to clear the trigger guard 27 from the strap 22.

Next, the user assumes an upward-forward movement of his arm as illustrated in FIG. 3 and the cylinder region 28 of the handgun 20 clears the holster. The barrel of the handgun 20 passes through the opening 15 in the front of the holster 10 from the position shown in FIG. 3 to the position shown in FIG. 4 from which it may be leveled and fired. It should be noted that the muzzle of the handgun 20 need not rise above the waist of the user in the process of being drawn from our holster in contrast with conventional top opening holsters. This feature increases the speed and ease of drawing nearly as much as in the case of front opening holsters as illustrated by U.S. Pat. Nos. 3,997,583, 3,749,293 and 3,630,420.

Figure 5:
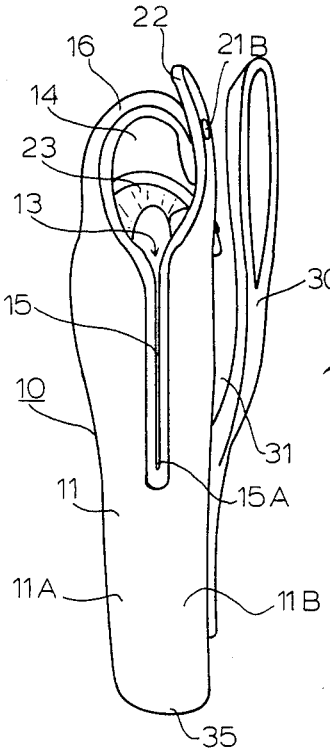
FIGS. 5 and 6 are front and rear elevational views respectively of this invention.
Figure 6:
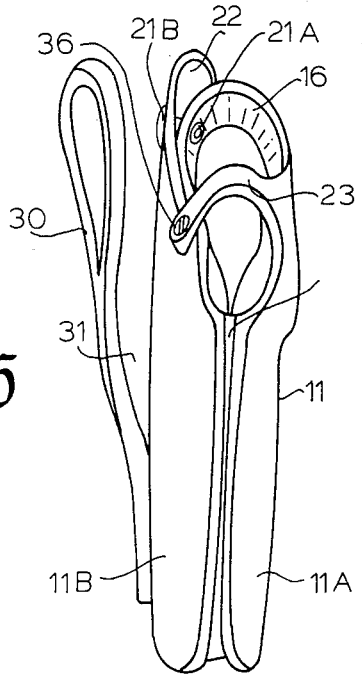

The details of the holster as seen by the user are more apparent by reference to FIGS. 5 and 6 which show the front and rear views of the holster respectively. The front view as viewed from the front of the wearer shows clearly the belt loop assembly 30 with it's offset 31 and as a dominant feature the semi-front opening which is shown, in this embodiment to extend approximately one half of the distance from the intersection of the top opening 14 and the front extension 15 of that opening to the bottom 35 of the holster. The length of the front opening 15 may be varied but we have found that the opening should be at least one-fourth of the length of the holster and one-half length to be optimum. This allows the pivoting of the handgun forward against the lower edge 15A of the front opening 15 in drawing in order to clear the trigger guard 27 of the handgun from the strap 23.

Figure 9:
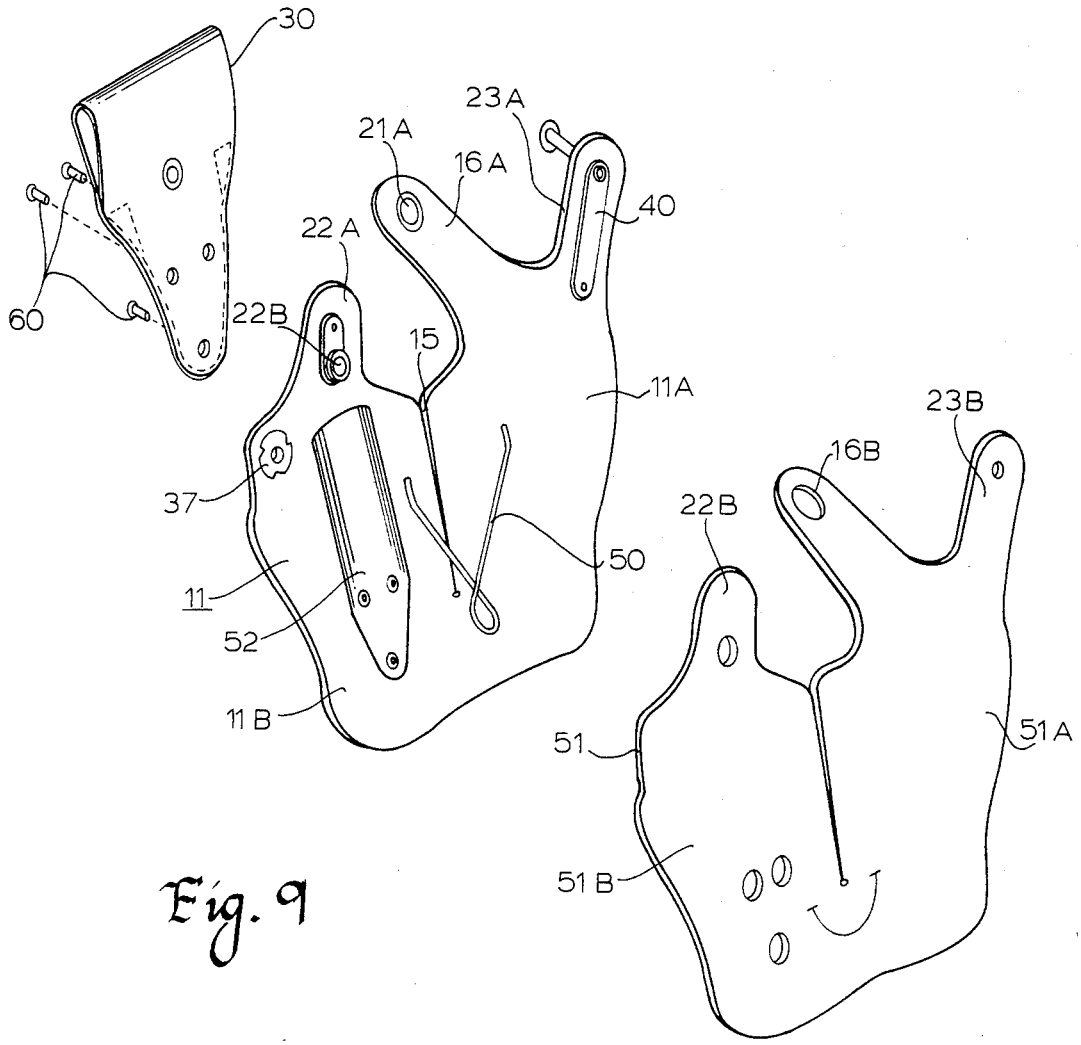

The positive connection of the strap 23 to the face 11B of the holster is illustrated in FIG. 6 in which the fastening means is shown to be a screw fastener 36 mating with an internal "Speednut" 37 illustrated in the exploded view, FIG. 9 but unshown in FIG. 6. The strap 23 is further reinforced by the internal metal stiffener 40 of FIG. 9. Given the positive connection between the strap 23 and the inside of the body 11B and the internal reinforcement 40, the strap 23 forms a positive barrier to removal of the handgun upward without first clearing that strap in the manner illustrated in FIG. 2. Any attempt by an assaliant to draw the handgun from the rear will not be successful due to the coaction of the strap 23 and the holster body 11. Furthermore, the assailant may not pivot the handgun rearward and downward on the butt of the gun since the barrel is securely held in place by the fold 12.

Any attempt by an assailant to pivot the handgun forward, even if he would have the mind to do so, would not be successful unless he first released the hammer guard strap 16. Any attempt to release the fixed strap 23 would be useless. Thus, this invention provides an additional degree of protection from assailants as compared with previous front opening holsters.

Figure 7:
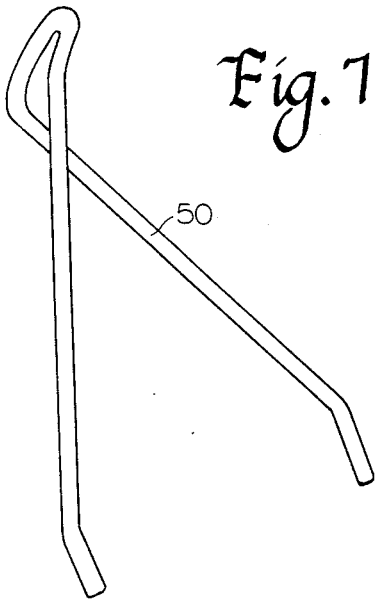
FIG. 7 is a perspective view of a spring used in this invention in unrestrained form.
Figure 8:
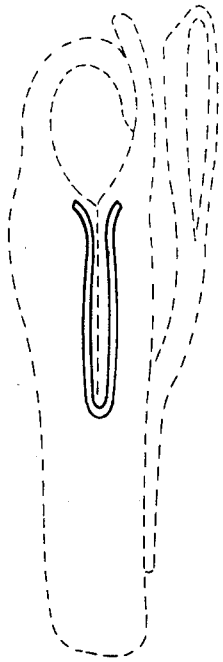
FIG. 8 is a front elevational view of the spring of FIG. 7 in its installed position with the holster shown in dashed lines; an FIG. 9 is an exploded view of this invention.

The maintenance of the front opening 15 in a normal closed position and provision of a firm, smooth resistance to draw is provided by the internal spring 50 shown in its unrestrained form in FIGS. 7 and 9 and in its normal in place configuration in FIG. 8. The spring 50 has the same general configuration as the spring disclosed in U.S. Pat. No. 3,630,420 but is shorter. It includes end bends 50A and 50B which serve to bias the intersection of the front opening 15 and the top opening slightly outward to facilitate drawing.

Now referring specifically to FIG. 9, the holster of this invention may be seen as being lined by suede or other soft material in the form of a lining 51 which is the mirror image of the holster body 11 to protect the handgun from contact with any of the internal metal parts such as the reinforcement 40 for strap 23, the spring 50 and the body reinforcing backup plate 52 as well as "Speednut" 37. The two fastener parts 21A and 22B are both visible in this FIG. 9 with the mating side of fastener 22B appearing in the figure and the rear of the fastener 21A in view. When the liner 51 is joined to the holster body as by cementing and the holster body 11 folded over with side 11A approaching side 11B and the edges of the liner sides 51A and 51B in contact, the holster body 11 may be sewn together. A welt, not shown in the drawing may be included between the rear edges for additional thickness. The holster body 11 is then sewn together generally in the stitch pattern shown in FIG. 1. The belt loop assembly 30 is joined to the holster body by fasteners 60 such as machine screws engaging mating nuts 61 secured to the body reinforcing member 52. The strap 23 with the reinforcement strip 40 bent into generally an arch shape, the fastener 36 may be secured to "Speednut" 37 and the holster is complete. Note that the thumb tab 22 is likewise stiffened by a flat strap 29 which serves to hold the thumb strap 22 stiff and to assure its easy separation from the hammer strap 16 by the user's thumb. The fasteners 21 and 22 are preferably directional release snap fasteners such as those which release from one direction only, oriented to open from the rear.

Given the combination described above, we have produced a semi-front opening holster which offers most of the advantages of former front opening holsters and includes positive protection from upward or rearward drawing of the handgun. It further provides for positive protection against a straight forward removal of the handgun as by pressure on the gun butt since the muzzle is trapped in the front fold and the hammer guard until released prevents forward movement. This holster has more of the appearance of a conventional holster as opposed to a full front opening holster and can be drawn in a more comfortable action than top opening holsters thus affording the advantages of front opening and top opening holster and certain advantages over both.

The foregoing constitutes a disclosure of the best mode known to us for carrying out this invention but is by no means limited to the embodiment illustrated. The scope of this invention is instead determined from the following claims and their equivalents.

What is claimed is:

1. A semi-front opening holster comprising a body of leather or leatherlike material formed to define a handgun carrying pouch;

means secured to said body for securing the holster to a belt;

said body defining a top opening for the insertion of a handgun into the holster from the top;

said body at the upper rear thereof defining a pouch region for at least partially enclosing the trigger guard of a handgun when positioned within the holster;

said pouch region including means extending above and over the trigger guard of the handgun whereby a handgun within said holster may not be withdrawn directly upward;

and strap means extendable from one side of the holster to the opposite over the hammer region of the handgun when in position within said pouch, said strap normally urging the handgun rearward in said pouch beneath said last means, said strap means being partly disengageable to allow the handgun to move forward;

said holster body defining an extension of said top opening along a portion only of the front edge thereof, thereby defining a partial front opening;

whereby a handgun contained within said holster may be removed by tilting forward to clear the trigger guard from said pouch region disengaging said strap means and thereafter removing the handgun entirely from said holster by an upward or upward-forward movement but said handgun may not be removed by merely an upward or frontward movement including spring means secured to said body biasing the portions of said body defining said extension of the top opening together whereby withdrawal of the handgun requires the overcoming of the spring resistance of said spring means, wherein said spring means comprises a generally U-shaped wire spring with the opening of the U in the region intersection of the top opening and the extension thereof.

* * * * *